US009844807B2

(12) United States Patent
Yalin et al.

(10) Patent No.: US 9,844,807 B2
(45) Date of Patent: Dec. 19, 2017

(54) TUBE WITH FINS HAVING WINGS

(75) Inventors: Qiu Yalin, Shanghai (CN); Wu Yongquing, Shanghai (CN); Cao Jianying, Shanghai (CN); Luo Zhong, Shanghai (CN)

(73) Assignee: Wieland-Werke AG, Ulm (DE)

( * ) Notice: Subject to any disclaimer, the term of this patent is extended or adjusted under 35 U.S.C. 154(b) by 1514 days.

(21) Appl. No.: 12/103,826

(22) Filed: Apr. 16, 2008

(65) Prior Publication Data

US 2009/0260792 A1 Oct. 22, 2009

(51) Int. Cl.

| | |
|---|---|
| ***F28F 1/36*** | (2006.01) |
| ***F28F 13/18*** | (2006.01) |
| ***B21C 37/20*** | (2006.01) |
| *F28F 1/42* | (2006.01) |

(52) U.S. Cl.

CPC ..... *B21C 37/207* (2013.01); *F28F 1/36* (2013.01); *F28F 1/422* (2013.01); *F28F 13/187* (2013.01); *Y10T 29/49378* (2015.01)

(58) Field of Classification Search

USPC ..... 165/133, 184

See application file for complete search history.

(56) References Cited

U.S. PATENT DOCUMENTS

| | | | | |
|---|---|---|---|---|
| 3,171,389 | A | 3/1965 | Throckmorton et al. | |
| 3,753,364 | A | 8/1973 | Runyan et al. | |
| 3,768,290 | A | 10/1973 | Zatell | |
| 4,168,618 | A | 9/1979 | Saier et al. | |
| 4,179,911 | A | 12/1979 | Saier et al. | |
| 4,306,619 | A | 12/1981 | Trojani | |
| 4,313,248 | A | 2/1982 | Fujikake | |
| 4,549,606 | A | 10/1985 | Sato et al. | |
| 4,660,630 | A | 4/1987 | Cunningham et al. | |
| 4,729,155 | A | 3/1988 | Cunningham et al. | |
| 4,796,693 | A | 1/1989 | Kastner et al. | |
| 5,203,404 | A * | 4/1993 | Chiang et al. | 165/133 |
| 5,333,682 | A | 8/1994 | Liu et al. | |
| 5,513,699 | A | 5/1996 | Menze et al. | |

(Continued)

FOREIGN PATENT DOCUMENTS

| | | |
|---|---|---|
| CN | 101004335 A | 7/2007 |
| JP | 54-19247 | 2/1979 |

(Continued)

OTHER PUBLICATIONS

International Search Report and Written Opinion of the International Searching Authority for PCT/US08/60567; dated Sep. 29, 2008.

(Continued)

*Primary Examiner* — Leonard R Leo

(74) *Attorney, Agent, or Firm* — Muncy, Geissler, Olds & Lowe, P.C.

(57) ABSTRACT

Fins are formed monolithically from the material of a tube body. The fins extend from the tube body outer surface, and include a fin base and a fin top. Wings extending from a fin side surface between the fin base and fin top can produce upper and lower channels between adjacent fins. Depressions can be formed in the fin top with platforms below the depressions. The tube can also include helical ridges on an inner surface of the tube. The tubes are used for heat transfer, and can be included in shell and tube heat exchangers.

23 Claims, 6 Drawing Sheets

(56) References Cited

U.S. PATENT DOCUMENTS

| | | | | |
|---|---|---|---|---|
| 5,669,441 | A * | 9/1997 | Spencer | 165/184 |
| 5,697,430 | A | 12/1997 | Thors et al. | |
| 5,775,411 | A | 7/1998 | Schuez et al. | |
| 5,896,660 | A | 4/1999 | Rieger | |
| 6,067,832 | A | 5/2000 | Brand et al. | |
| 6,167,950 | B1 * | 1/2001 | Gupte et al. | 165/133 |
| 6,173,762 | B1 | 1/2001 | Ishida et al. | |
| 6,457,516 | B2 | 10/2002 | Brand et al. | |
| 6,786,072 | B2 | 9/2004 | Beutler et al. | |
| 6,883,597 | B2 | 4/2005 | Thors et al. | |
| 6,913,073 | B2 | 7/2005 | Beutler et al. | |
| 7,178,361 | B2 | 2/2007 | Thors et al. | |
| 7,254,964 | B2 | 8/2007 | Thors et al. | |
| 2007/0034361 | A1 | 2/2007 | Lu et al. | |
| 2007/0131396 | A1 | 6/2007 | Yu et al. | |
| 2007/0151715 | A1 | 7/2007 | Yunyu et al. | |

FOREIGN PATENT DOCUMENTS

| | | |
|---|---|---|
| JP | 2000-283678 | 10/2000 |
| JP | 2002-277188 | 9/2002 |
| JP | 2002-372390 | 12/2002 |

OTHER PUBLICATIONS

JP 2011-504979, Office action and English translation.

* cited by examiner

TUBE WITH FINS HAVING WINGS

BACKGROUND OF THE INVENTION

Field of the Invention

The current invention describes finned tubes used for heat transfer, such as the tubes used in shell and tube heat exchangers.

Description of the Related Art

Finned tubes have been used for heat transfer for many years. Heat flows from hot to cold, so heat transfer is accomplished by conducting heat from a warmer material to a cooler material. There is also heat given off when a material condenses from a vapor to a liquid, and heat is absorbed when a liquid vaporizes or evaporates from a liquid to a vapor. When finned tubes are used for heat transfer, the warmer material is on either the inside or the outside of the tube and the cooler material is on the other side. Usually the tube allows for the transfer of heat without mixing the warmer and cooler materials.

For cooling purposes, a cooling medium can be a liquid such as cooling water flowing through a shell and tube heat exchanger, or it can be a gas such as air blown over a finned tube. Similarly, a heating medium can be either a liquid or a gas. Finned tubes are sometimes used instead of relatively smooth tubes because finned tubes tend to increase the rate of heat transfer. Therefore, a smaller heat exchanger with finned tubes may be able to transfer as much heat in a given application as a larger heat exchanger with relatively smooth tubes. The design of finned tubes affects the rate of heat transfer and sometimes the tubes are designed differently for specific heat transfer applications. For example, finned tubes used for condensation tend to have different designs than finned tubes used for evaporation.

Examples of the prior art include finned tubes with helical ridges formed on an inner surface of the tube and fins formed on an outer surface of the tube. A channel is defined by adjacent fins on the tube outer surface, and this channel can have a curved, "U" shaped bottom or the channel can have a flat bottom. When used as condensing tubes with the condensing vapor on the outside of the tube and coolant inside the tube, the channels tend to become filled with liquid condensate. The condensate serves to insulate the tube and restrict the cooling needed for further condensation. The flat bottom is preferred because condensate tends to spread out along the bottom of the flat channel instead of creeping up the sides of the fins. This leaves more surface area on the fins free of condensate which enhances heat transfer.

Finned tubes also have had breaks formed in the fins so condensate flowing within a channel between two fins could flow through a break and enter a different channel. Other finned tubes have had the outer portion of the fin bent over so that a bend is formed part of the way between a base of the fin and a top of the fin. This creates additional angles in the fin which tends to cause the tube to shed liquid condensate more rapidly. When liquid condensate is shed from a tube more rapidly, it tends to enhance heat transfer. Other fins have had notches formed in the fin tip with peaks defined between the notches. In some cases the peaks are bent over to form a curl shape. This again increases curvature and angles in the fin and thereby tends to cause the tube to shed liquid condensate more rapidly.

Some finned tubes are produced by attaching fin material to a relatively smooth tube so the fins are not formed from the material of the tube body. This increases the area available for heat transfer, which does improve heat transfer rates, but the interface between the fin and the tube does cause some resistance to heat flow. The fins attached to the tube can extend radially from a tube axis so they stand straight up from the tube, but they can also be curved or bent in various ways to improve heat transfer. There are many designs of finned tubes in existence, but any change which improves heat transfer is always welcome.

BRIEF SUMMARY OF THE INVENTION

A tube used for heat transfer has fins extending from an outer surface of the tube. The fins are formed from the material of the tube outer surface, so the fins are monolithic with the tube body. Wings extend from a side surface of the fin between a fin base and a fin top. The wings can extend to approximately the center of a channel defined by two adjacent fins such that the wings split the channel into an upper channel and a lower channel. The tube can include helical ridges formed on an inner surface of the tube, and the tube can include depressions formed in the fin tops.

DETAILED DESCRIPTION

Figure 1:
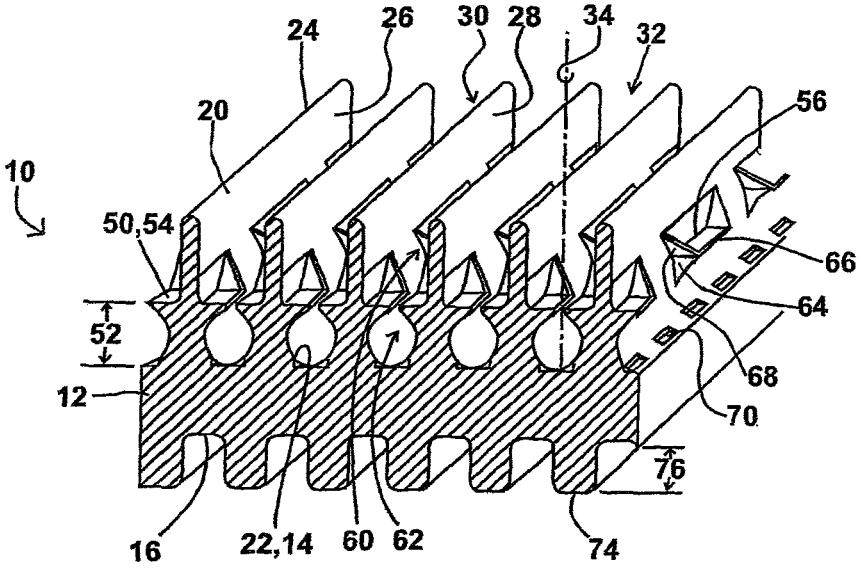
FIG. 1 is a perspective view of a section of the finned tube.

The finned tube of the current invention is used for heat transfer, and primarily for condensation of a liquid onto the tube outer surface. In a typical example, a cooling liquid flowing through the tube interior absorbs the heat of condensation as a vapor condenses. The design of the fins on the tube outer surface increase heat transfer by increasing surface area of the tube, and by improving the tube's condensate shedding ability. Other aspects of the tube design also improve heat transfer rates. The tube is most often used in the construction of shell and tube heat exchangers, but it is also possible to use the finned tube in other heat transfer applications.

Condensation Principles

When heat is transferred from a condensing vapor on the outside of a tube to a cooling liquid on the inside of a tube, the heat transfer is considered in several distinct steps. The same basic steps apply when heat is transferred through a barrier, such as a tube wall, between any two mediums with different temperatures. This description is directed towards a condensing vapor on the outside of the tube and a cooling liquid on the inside of the tube, but different applications are possible.

The vapor outside the tube has transfer heat to cooling liquid inside the tube. As a vapor condenses, a specific amount of heat referred to as the heat of condensation is given off. There is generally a layer of liquid condensate on the tube outer surface, so the first step is the transfer of heat from the vapor to the condensate on the tube. The heat then flows through the condensate, and condensate often resists heat flow because it acts as an insulator. After heat flows through the condensate, it is transferred from the condensate to the tube outer surface. There is an interface between the condensate and the tube outer surface, and any interface provides some resistance to heat flow.

Once heat is transferred to the outer surface of the tube, it has to flow from the outer to the inner surface of the tube. To facilitate this heat flow, heat transfer tubes are usually made out of a material which readily conducts heat, or a heat conductor. Generally there is a thin layer of liquid contacting the inner surface of the tube wall which is essentially stagnant. After the heat flows through the tube wall, it must be transferred through the interface between the inner surface of the tube wall to the adjacent layer of cooling liquid inside the tube. Heat then has to flow through this thin layer of liquid.

The more turbulent or rapid the flow of cooling liquid within the tube, the thinner the layer of stagnant liquid sitting next to the tube wall. Therefore, tube designs which cause mixing or agitation of the liquid within the tube provide a benefit. Turbulent flow causes mixing of the cooling liquid, as compared to laminar flow, and higher cooling water flow rates can increase the turbulence of the cooling water. Features of the tube inner surface can also increase the turbulence and mixing of the cooling liquid inside the tube. Heat transferred to the flowing cooling liquid in the tube is then carried away as the liquid exits the tube.

An interface between the fins and the tube exists if the fins are constructed separately from the tube, and then attached. This is true if the fin and tube are constructed of the same material, such as copper, or from different materials. Any interface causes some resistance to heat flow. If the fins are formed from the tube wall, there is no interface and heat flow is improved. In this discussion, fins formed from the tube wall are referred to as being monolithic with the tube, and it is preferred that fins be monolithic with a tube to minimize resistance to heat flow.

The tube should be made from a malleable substance so the fins can be formed from the tube without cracks or breaks forming in the tube wall. Cracks or breaks limit the structural integrity and strength of a tube. Generally these tubes are used in shell and tube heat exchangers, and the ends of the tubes are affixed in tube sheets of the heat exchanger. A malleable tube can be easier to install in a heat exchanger tube sheet. The tube should also be constructed from a material which readily conducts heat. Copper is often used in tube construction because of its malleability and heat conducting properties.

Finned tubes have design considerations specifically related to the collection of condensate on the tube outer surface. Some tubes are better at shedding the condensate than others. If condensate is shed more rapidly, the layer of condensate on the tube is thinner and there is less resistance to heat flow. Therefore, a tube that more rapidly sheds condensate tends to be preferred because it provides a more rapid heat flow.

One aspect that causes a tube to shed condensate more quickly is the ability of the outer surface to concentrate the condensate into drops. This is frequently done by having sharp points or curves on the outer surface. If a sharp point or curve is concave in nature, it tends to act as an accumulation site for condensate drops because surface tension tends to cause the condensate to collect in concave surface features. Convex surfaces tend to avoid condensate because surface tension effects tend to cause the condensate to avoid these areas. Therefore, convex areas tend to remain relatively free of condensate and have less resistance to heat flow. Concave areas tend to concentrate condensate into drops which can then more rapidly fall from the tube, so the tube sheds condensate more quickly. Curves or sharp points generally produce both convex and concave surfaces at different locations, which promotes more rapid condensate shedding, as well as areas on the tube with very little or no condensate which more rapidly transfer heat.

It is also true that the more surface area on a condensing tube, the more rapid the flow of heat. When fins are formed on a tube it increases the surface area of the tube, which serves to increase the rate of heat transfer across the tube. Other deformations in the tube outer surface which increase surface area will also tend to increase the rate of heat transfer.

Finned Tube Main Body

Figure 2:
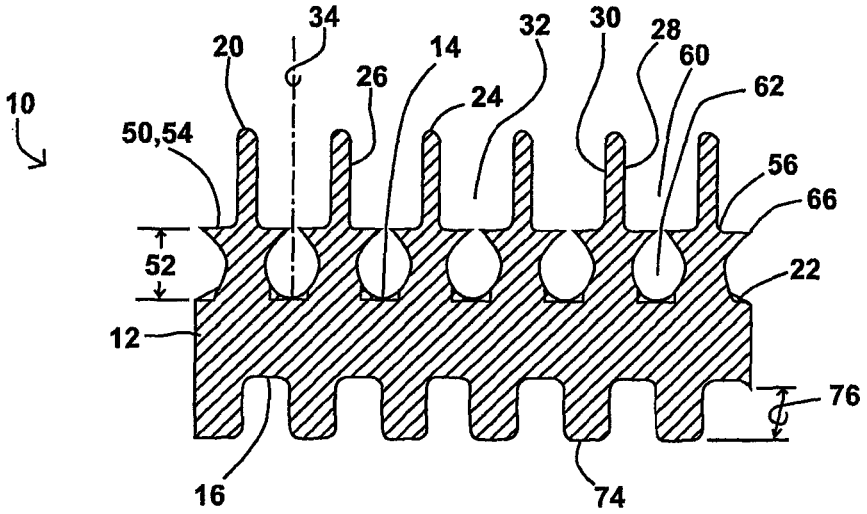
FIG. 2 is a side sectional view of the finned tube.
Figure 3:
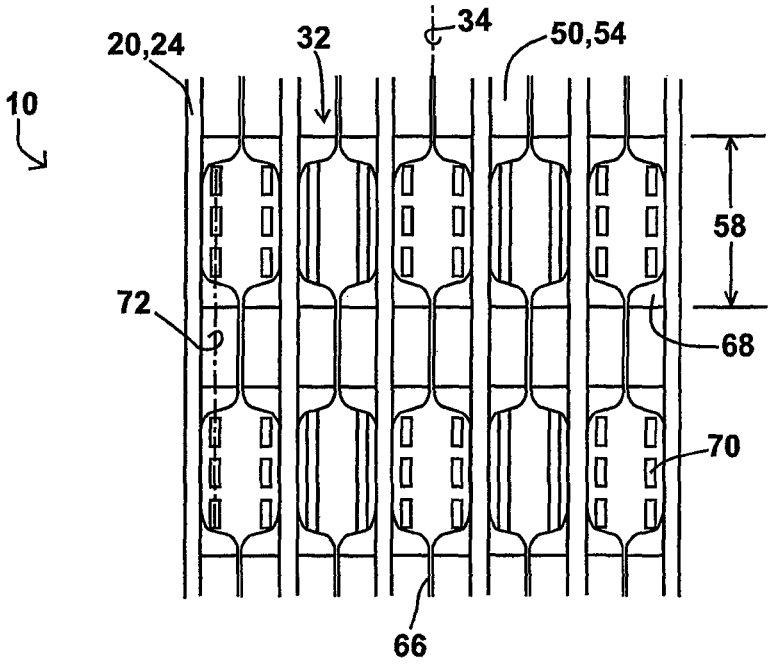
FIG. 3 is a top view of the outer surface of the tube.

One embodiment of the finned tube 10 of the current invention is shown in different perspectives in FIGS. 1, 2 and 3. The tube 10 includes a main body 12 which has an outer surface 14 and an inner surface 16. The main body 12 is the base for any shapes or structures on the outer or inner surface 14, 16. This main body should be made of a material which conducts heat readily. Metals are generally good conductors and are frequently used for the construction of tubes of the current invention. The material should also be malleable such that the various structures on the inner and outer surface 14, 16 can be formed without damaging the integrity of the tube body 12. This allows for the structures formed from the tube body 12 to be monolithic with the tube body 12.

Tube Fins

The tube 10 has at least one fin 20 formed on its outer surface 14. The fin 20 generally protrudes or extends circumferentially from the tube body outer surface 14, and is usually helical. It is possible that one single fin 20 is helically wound around the entire length of the tube 10. It is also possible that there will be a plurality of fins 20 which are all received helically around the tube 10. In either case, when looking at a section of the tube body outer surface 14, it will appear as though there are several adjacent circumferential fins 20 protruding from the tube body outer surface 14. When viewed along the axial direction of the tube 10, fin 20 sections next to each other are referred to as adjacent fins 20 despite the fact that they might be the same fin 20 helically wrapping around the tube body outer surface 14. The fin 20 is formed from the material of the tube body 12, so the fin 20 is monolithic with the tube body 12.

Each fin 20 has several parts including a fin base 22 at the point where the fin 20 connects to the tube body outer surface 14. The fin top 24 is opposite the fin base 22 and is the highest point of the fin 20 relative to an axis of the tube 10. A fin side wall 26 includes a first side wall 28 and a second side wall 30 opposite the first side wall 28. A channel 32 is defined between two adjacent fins 20, and the channel 32 has a channel center 34. The channel center 34 is equidistant from the two adjacent fins 20 which form the channel 32. The fin 20 can be approximately perpendicular to the tube body 12 such that the fin 20 extends essentially straight out from the tube body outer surface 14. In such a case, the fin 20 would extend radially from the tube 10. It is also possible for the fin 20 to be positioned at other angles to the tube body outer surface 14.

Figure 4:
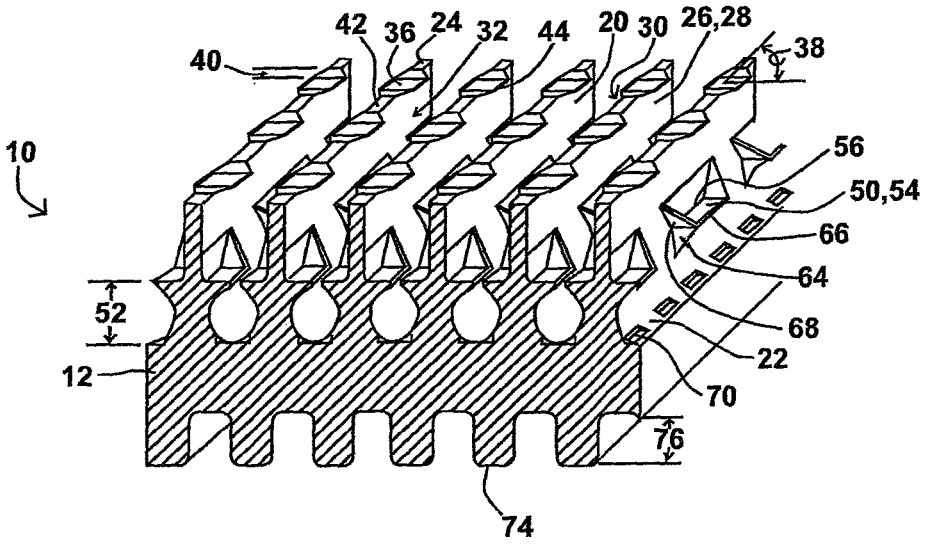
FIG. 4 is a perspective view of a section of the finned tube with depressions in the fin top.

The fin top 24 can have a plurality of depressions 36, as best seen in FIG. 4. The depressions 36 have a skew angle 38 which is defined by the angle of the depression 36 relative to the fin top 24. The skew angle 38 can range between 0 to 90° such that the depression 36 can be perpendicular to the fin 20 or the depression 36 can be set at a different angle to the fin 20. The depression has a depth 40 which generally ranges between 0.01 to 0.5 millimeters. A plurality of peaks 42 are defined between adjacent depressions 36. When depressions 36 are formed in the fin top 24, a platform 44 can be formed extending from the fin top 24. The platform 44 extends from the fin top 24 at the depressions 36 because the fin top 24 undulates up and down with the depressions 36 and peaks 42. The plurality of platforms 44 provides additional curvature, angles, and surface area in the fin 20.

Wings

Referring again to FIGS. 1, 2 and 3, the fin 20 includes a wing 50 extending or protruding from the fin side wall 26 between the fin top 24 and the fin base 22. The wing 50 can be positioned near the middle of the side wall 26, closer to the fin top 24, or closer to the fin base 22, but not at the fin top 24 or the fin base 22. Preferably, there are a plurality of wings 50, and the wings 50 can be approximately perpendicular to the fin side wall 26 or they can be set at other angles to the fin side wall 26. When more than one wing 50 is on one fin side wall 26, a gap 58 is defined between adjacent wings 50. The wings have a height 52 defined as the distance from the fin base 22 to a wing upper surface 54. If the wing 50 is set at an angle other than 90° to the fin side wall 26, the wing height 52 is defined as the distance from the fin base 22 to the highest point on the wing upper surface 54.

The wing 50 has a wing base 56 at the point where the wing 50 connects to the fin side wall 26. Generally, the wing base 56 is approximately parallel to the fin base 22, but it is possible for the wing base 56 to be at an angle which is not parallel with the fin base 22. The wing 50 can extend from the side wall 26 to approximately the channel center 34, but the wing 50 can extend to a point short of the channel center 34 or even a point beyond the channel center 34. Wings 50 can extend from both the fin first side wall 28 and the second side wall 30 such that wings 50 from adjacent fins 20 each reach into the channel 32 defined between the adjacent fins 20. The wings 50 extending from adjacent fins 20 into the channel 32 can be aligned, as shown, but it is also possible that wings 50 are staggered such that a wing 50 extending into the channel 32 would be positioned across from the gap 58 between two wings 50 on the adjacent fins 20.

The surface area of the wings 50 is maximized by extending the wings 50 to approximately the channel center 34. When reference is made to extending the wings 50 to approximately the channel center 34, it is intended to mean that wings 50 opposite each other extending together form an effective barrier such that liquids will not easily pass between the wings 50. This does not mean the opposite wings 50 have to actually touch at the channel center 34, but the wings 50 should be close to each other, and it is acceptable if the wings 50 do actually touch. This effective meeting of opposite wings 50 at the channel center 34 can aid in condensation, because the wings 50 can interact with each other to affect the surface tension of the liquid to aid in the overall condensation efficiency of the tube 10.

Figure 5:
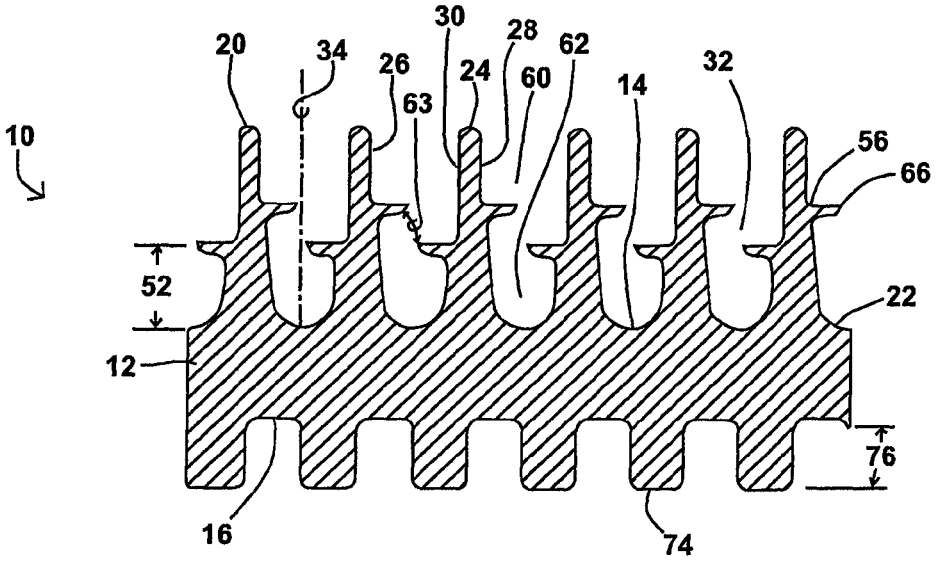
FIG. 5 is a side sectional view of an embodiment of the finned tube with opposite wings at different wing heights.
Figure 6:
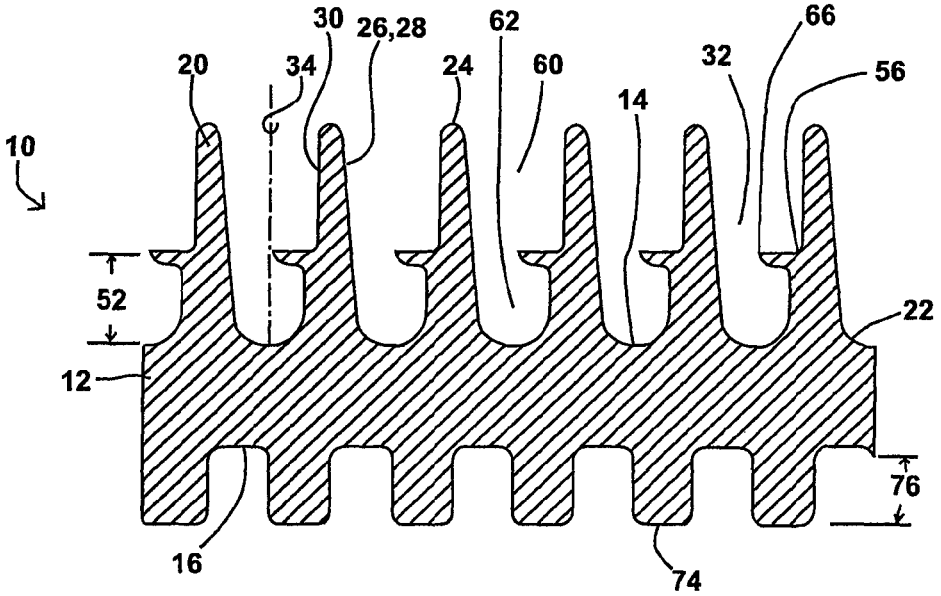
FIG. 6 is a side section view of an embodiment of the finned tube with a wing on only one fin side wall.

The wing 50 splits the channel 32 into an upper channel 60 and a lower channel 62. Condensate can flow through both the upper and lower channels 60, 62 and more inter-channel flow can be accommodated by various positions for the wing 50. One example of this is shown in FIG. 5, with different wing heights 52 on the first and second fin side walls 28, 30. In this manner, the wings 50 extending into the channel 32 have a larger space 63 between the wings 50, which does not restrict the flow of condensate as much as if the facing wings 50 were at the same wing height 52. A second option for improving inter-channel flow involves positioning a wing 50 on only one fin side wall 26, as seen in FIG. 6. In this case, one of the first and second side walls 28, 30 has a wing 50 extending from it, and the other of the first and second side wall 28, 30 does not.

Referring now to FIGS. 1, 2, and 3, the wing 50 has a side surface 64 extending from the wing base 56 to a wing terminus 66. The side surface 64 faces the gap 58 defined between adjacent wings 50 on a single fin side wall 26. A plurality of shelf walls 68 can be included, wherein the shelf walls 68 extend between the wing side surfaces 64 and the fin side wall 26. The shelf wall 68 extends upwards from the wing 50, so the shelf wall 68 extends towards the fin top 24. An angle or sharp point is produced at the wing side surface 64, where the wing 50 and the shelf wall 68 intersect. This angle generally varies between about 90 degrees and about 170 degrees. The shelf wall 68 can point essentially directly towards the fin top 24, but a more gradual angle at the wing side surface 64 results in the shelf wall 68 pointing at an angle towards the fin top 24.

Figure 1A:
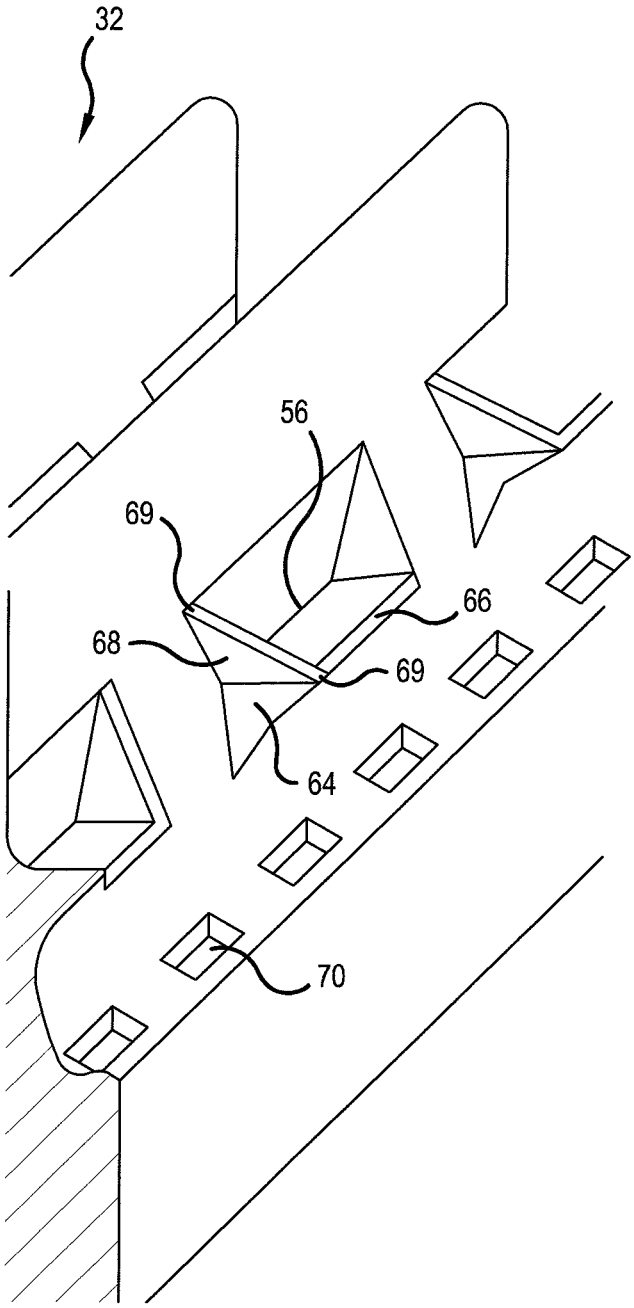

The shelf wall 68 aids in condensation, because it provides several sharp points and angles. The shelf wall 68 has sharp points 69 (as shown in FIG. 1*a*) and angles at the intersection and connection point with the fin side wall 26, at the intersection and connection point with the wing side surface 64, and at a shelf wall outer edge where the end of the shelf wall 68 projects into the channel 32. There are angles and sharp points on both the top and bottom surfaces where the shelf wall 68 intersects other structures. Besides connecting the wing side surface 64 and the fin side wall 26 and creating sharp points and angles, the shelf wall 68 also increases surface area, which aids in condensation.

The wing 50 generally provides a relatively flat wing upper surface 54 with clearly defined boundaries. The wing base 56 is generally a straight line, as well as the two wing side surfaces 64 and the wing terminus 66. These four generally straight boundaries provide a wing upper surface 54 with a quadrilateral shape. Each boundary of the wing 50 provides a sharp point or an angle to improve condensation.

It is possible to provide too many wings 50 such that condensate can become trapped in the lower channel 62. This could hinder the ability of the tube 10 to shed condensate. Therefore, the gap 58 between adjacent wings 50 on a single fin side will 26 and the space 63 between wings 50 on facing fin side walls 26 has to be considered in the design of the current invention. Related considerations include the wing heights 52 of opposing wings 50 extending into a single channel 32, and the distance between the wing terminus 66 and the channel center 34.

Channel Mark

Channel marks 70 can be formed on the tube body outer surface 14 within the fin channel 32. Channel marks 70 are basically a recess defined in the tube body outer surface 14. The channel mark 70 can be continuous or intermittent, wherein a continuous channel mark 70 would be similar to a groove formed circumferentially around the tube 10 within the fin channel 32, and intermittent channel marks 70 would be a plurality of discreet depressions defined in the fin channel 32. The channel marks 70 shown are intermittent. The channel marks 70 can be formed basically a line, so that the channel marks 70 define a channel line 72. The channel line 72 can be approximately parallel with the fin channel 32 or the fin base 22. The channel line 72 is defined by the row of channel marks 70.

There can be one channel line 72 or a plurality of channel lines 72 within one fin channel 32. The channel lines 72 can be at or near the channel center 34, they can be offset from the channel center 34 near the fine base 22, or they can be anywhere in between. If there are two or more channel lines 72 and the channel marks 70 are intermittent, the channel marks 70 can be simultaneous or alternating. If the channel marks 70 are simultaneous, they will be aligned directly across from each other, as shown. If the channel marks 70 are alternating, they will be aligned such that the channel marks 70 in one channel line 72 are not directly across from channel marks 70 in another channel line 72 within the same fin channel 32.

The channel marks 70 can have a multitude of shapes. They can be square, rectangular, trapezoidal, polygonal, triangular or almost any other shape. The channel marks 70 tend to serve as nucleation sites for condensation. They also serve as sharp corners or angles which tend to aid in drop formation because they provide an accumulation site for the condensate. The channel marks 70 also increase surface area, which helps with heat transfer. The channel marks 70 can extend into the tube body 12 and therefore they can reduce the strength of the tube 10. Therefore, the channel marks 70 and channel line 72 can be positioned near the fin base 22, where the thickness of the tube body 12 can be larger.

Inner Surface Ridges

Heat transfer across the tube 10 can be improved by providing better transfer of heat from the tube body inner surface 16 to the cooling liquid within the tube 10. Ridges 74 can be defined on the tube body inner surface 16 to help facilitate more rapid heat transfer. The ridges 74 on the inner surface 16 are generally helical and have a depth 76 and a frequency. The frequency is the number of ridges 74 within a set distance. The ridges 74 are also set at different cut angles relative to the tube axis. The depth 76 and the frequency of the ridges 74 can vary, and the cut angle can be set to cause the cooling liquid to swirl within the tube 10. A swirling liquid tends to increase heat transfer by increasing the amount of agitation within the cooling liquid.

Tube Forming Process

Figure 7:
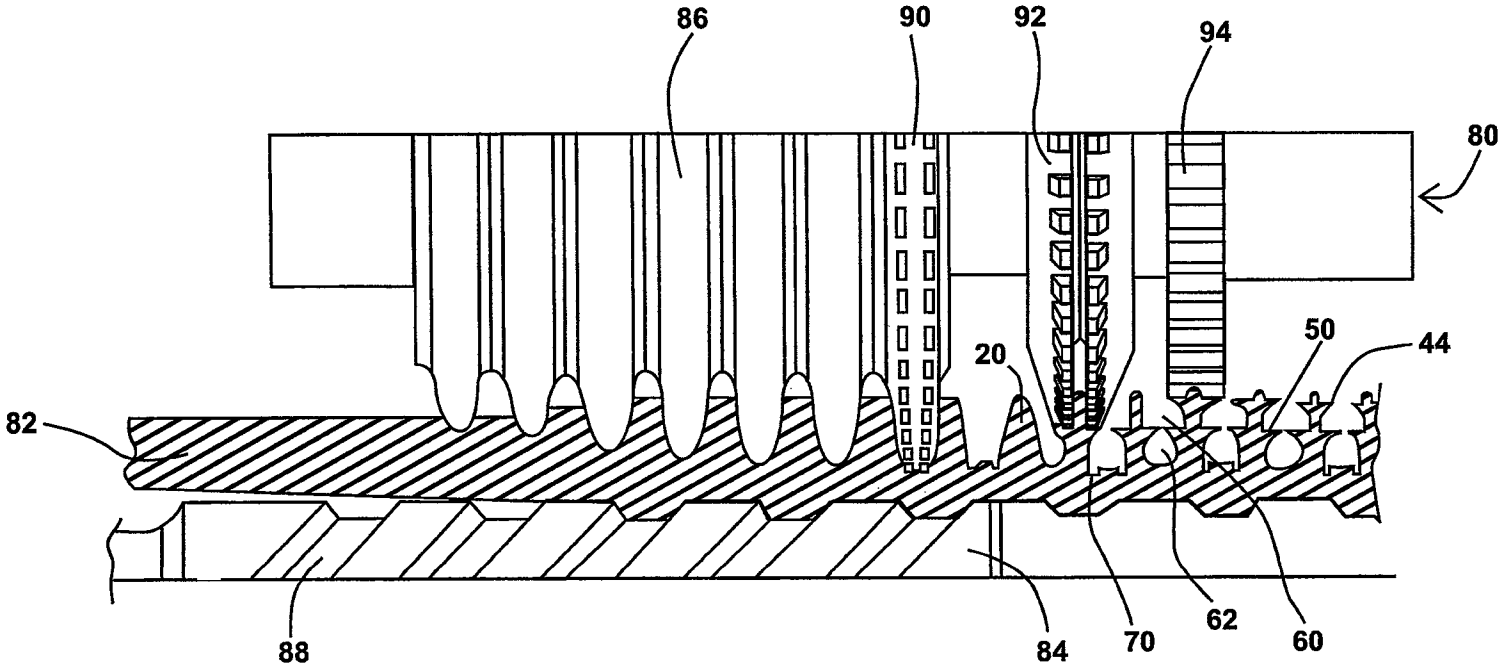
FIG. 7 is a side view of an arbor and inner support with a sectional view of a tube side wall between the arbor and inner support.

Finned tubes 10 are generally formed from relatively smooth tubes 10 with a tube finning machine, which is well known in the industry. The tube finning machine includes an arbor 80 as seen in FIG. 7, with continuing reference to FIGS. 1, 2, and 3. Frequently, a tube finning machine will include three or more arbors 80 positioned around the tube 10, so the tube 10 is held in place by the arbors 80. The arbors 80 are positioned and angled such that each complements the others. A tube is provided and fed through the finning machine such that a tube wall 82 is positioned between the arbor 80 and an inner support 84. The arbor 80 deforms the tube outer surface 14, and the inner support 84 can deform the tube inner surface 16. The tube wall 82 is generally rotated relative to the arbor 80 and moves axially with the inner support 84 as it rotates.

The arbor 80 generally includes several fin forming discs 86 which successively deform the tube wall 82 to form one or more helical fins on the tube outer surface 14. Successive finning discs 86 tend to project deeper into the tube wall 82 such that fins 20 are formed and pushed upwards by the finning discs 86. The inner support 84 can include recesses 88 such that helical ridges 74 are formed on the tube inner surface 16 as fins 20 are formed on the tube outer surface 14.

After the finning discs 86 have formed the fins 20, various other discs can be included on the arbor 80 to further deform and define aspects of the final tube 10. These remaining discs can be included or excluded, as desired. After the finning discs 86, the channel mark disc 90 can be used to form channel marks 70 in the channel 32 defined by adjacent fins 20. After the channel mark disc 90, one or more wing forming discs 92 can be used to form wings 50 on the fin side surfaces 28 between the fin base 22 and the fin top 24. The wing forming disc 92 also forms the shelf wall 68, and the shape of the teeth on the wing forming disc 92 determine the shape and angle of the shelf wall 68. After the wing forming disc 92, a depression forming disc 94 can be mounted on the arbor 80. The depression forming disc 94 creates depressions in the fin top 24. In this manner, the various deformations of the original relatively smooth tube 10 are produced. There are other possible orders and designs of discs which can be used to achieve similar results.

Example Dimensions

The dimensions of the current invention can vary, but example dimensions are provided below which will give the reader an idea as to at least one embodiment of the current invention.

The inter-fin distance is the distance between a center point of two adjacent fins 20 and this distance can be between 0.3 and 0.7 millimeters.

The fin 20 has a thickness above the wing 50 which is referred to as the fin thickness, and this thickness can be between 0.05 and 0.2 millimeters.

The fin 50 has a height measured from the fin base 22 to the fin top 24, and the fin height would be measured from the fin base 22 to the fin top 24 at a peak 42 if the fin had depressions 36, and the fin height can be between 0.7 and 1.5 millimeters.

The wing 50 has a height 52 measured from the tube body outer surface 14 to the wing upper surface 54, and this wing height 52 can be between 0.15 and 0.6 millimeters.

The wing 50 has a thickness from the wing upper surface 54 to a bottom portion of the wing 50 which can be between 0.1 and 1 millimeter.

The fin side wall 26 has a depth below the wing 50 which can be between 0.2 and 0.6 millimeters.

The channel marks 70 have several dimensions. They have a length which is measured along the circumference of the tube 10, and this length can be between 0.1 and 1 millimeter. The channel mark 70 has a width which is measured along the axis of the tube 10, and this width can be between 0.1 and 0.5 millimeters. The channel mark 70 also has a depth which can be between 0.01 and 0.2 millimeters.

The depression 36 formed in the fin top 24 has a depth 40 which can vary between 0.01 and 0.5 millimeters, and the depression 36 has a width which can vary between 0.01 and 1 millimeter.

The ridge 74 formed on the tube body inner surface 16 has a height, and this height can be between 0.1 and 0.5 millimeters. The internal ridge angle with the axis can be set at 46°, and the ridge starts can vary between 8 and 50.

The outside diameter of the tube 10 can be 19 millimeters. The tube wall 82 has a thickness which can be 1.04 millimeters.

The wing spread, which includes the gap between adjacent wings 50 and one wing 50, can be between 0.6 and 6 millimeters. The wing spread would be measured from the start of one wing 50 to the start of the next adjacent wing 50. The wing width as measured along the wing base 56 can be between 0.1 and 0.5 millimeters.

Tube Benefits

The tube 10 as described is very effective when used for condensing a vapor on the outside surface 14 with a cooling liquid passed through the tube interior. This type of use in one example of how the tube 10 can be used. Condensation is facilitated because the outer surface 14 has lots of angles and sharp corners, and these angles and sharp corners provide areas where surface tension tends to cause the condensate to form into drops. When these drops are formed, they fall off the tube 10 more readily, so the tube 10 sheds condensate more quickly. Also, the channels 32 between the fins 20 facilitate flow of the condensate, which improves the rate at which drops escape or fall from the tube 10. This also improves the condensate shedding ability of the current invention. Condensate tends to avoid areas with convex curves, such as the edges of fins 20, wings 50, shelf walls 68, and platforms 44, because of surface tension effects. These relatively condensate-free areas provide less resistance to heat flow, which further promotes condensation rates.

The fins 20, wings 50, shelf walls 68, depressions 36, platforms 44, and channel marks 70 all add surface area to the tube outer surface 14. Heat flows across a surface, so more surface area tends to increase the rate of heat flow. Therefore, any formations on the tube outer surface 14 which increase surface area tends in increase the rate of heat flow.

The tube inner surface 16 also promotes heat transfer because the ridges 74 can cause turbulence and swirling of the cooling liquid. This turbulence and swirling cause a mixing which minimizes laminar flow, and also tends to minimize the depth of the liquid layer directly adjacent to the tube inner surface 16. The ridges 74 also increase the surface area of the inner surface 16, which facilitates heat transfer. A higher ridge frequency and/or a larger ridge depth 76 tends to increase heat transfer rates, but higher ridge frequencies and/or deeper ridges 74 also tend to increase resistance to flow of the cooling liquid through the tube 10. A lower flow rate of cooling liquid can slow heat transfer. Therefore, a balance must be struck for the best heat transfer conditions.

While the invention has been described with respect to a limited number of embodiments, those skilled in the art, having benefit of this disclosure, will appreciate that other embodiments can be devised which do not depart from the scope of the invention as disclosed here. Accordingly, the scope of the invention should be limited only by the attached claims.

What is claimed is:

1. A finned tube comprising a tube body having an inner surface and an outer surface;

at least one helical fin protruding from the tube body outer surface such that adjacent fin sections of the at least one helical fin define a channel having a channel center, wherein the fin is monolithic with the tube body and the fin includes a side wall, a fin top, and a fin base;

a plurality of wings protruding from the fin side wall between the fin top and fin base such that the wings extend to approximately the channel center, wherein the wings include a wing side surface and a wing upper surface, and wherein the wings have a wing base at a circumferentially extending line where the wing upper surface connects to the fin side wall;

a plurality of shelf walls angling upward from the wing and extending towards the fin top, the shelf walls connected to the fin side wall and the wing side surface;

a channel mark defined in the channel on the tube body outer surface;

a plurality of depressions defined in the fin top such that the fin top includes peaks defined between the depressions; and a helical ridge defined on the tube body inner surface.

2. The finned tube of claim 1, wherein the plurality of shelf walls project into the channel.

3. A finned tube comprising:

a tube body having an outer surface;

at least one fin extending helically from the tube body outer surface such that adjacent fin sections of the at least one fin define a channel having a channel center, where the fin is monolithic with the tube body, and the fin includes a fin side wall, a fin top, and a fin base;

a wing received between the fin top and the fin base, the wing extending from the fin side wall, where the wing includes a wing side surface and a wing upper surface, and wherein the wing has a wing base at a circumferentially extending line where the wing upper surface connects to the fin side wall;

a shelf wall angling upward from the wing and extending towards the fin top from the wing side surface, the shelf wall connected to the fin side wall and the wing side surface.

4. The finned tube of claim 3 wherein the wing is a plurality of wings defining a gap between adjacent wings extending from the same fin side wall.

5. The finned tube of claim 3 further comprising a channel mark defined in the tube body outer surface.

6. The finned tube of claim 5 wherein the channel mark is continuous.

7. The finned tube of claim 5 wherein the channel mark is intermittent, such that there are a plurality of channel marks.

8. The finned tube of claim 3 wherein the fin top further comprises a plurality of peaks and a plurality of depressions defined between adjacent peaks.

9. The finned tube of claim 8 further comprising a plurality of platforms extending from the fin top at the depressions.

10. The finned tube of claim 3 wherein the tube body includes an inner surface, the finned tube further comprising a ridge defined on the tube body inner surface.

11. The finned tube of claim 3 wherein the wing includes a plurality of wings, and wherein the fin side wall includes a first side wall and a second side wall opposite the first side wall, and wherein the wings extend from both the first and second side walls.

12. The finned tube of claim 3 where the shelf wall projects into the channel.

13. The finned tube of claim 3 where the connection between the shelf wall and each of the wing side surface and the fin side wall forms a sharp point.

14. A finned tube comprising:

a tube body having an outer surface;

at least one helical fin extending from the tube body outer surface, wherein the fin is-monolithic with the tube body and has a fin top, a fin base and a side wall, wherein the fin includes adjacent fin sections defining a channel having a channel center between the adjacent fin sections;

a wing extending from the fin side wall, wherein the wing is received between the fin top and the fin base, wherein the wing comprises a wing side surface and a wing upper surface, and wherein the wing has a wing base at a circumferentially extending line where the wing upper surface connects to the fin side wall; and a shelf wall connected to the wing side surface and to the fin side wall, where the shelf wall extends towards the fin top from the wing, and where the shelf wall projects into the channel.

15. The finned tube of claim 14 wherein the wing is a plurality of wings defining a gap between adjacent wings extending from the same fin side wall.

16. The finned tube of claim 15 where the fin side wall comprises a first side wall and a second side wall opposite the first side wall, and where the wings extend from the first and second side walls.

17. The finned lube of claim 14 where the wings extend to approximately the channel center from the fin side walls of the adjacent fin sections such that liquids cannot pass between the wings.

18. The finned tube of claim 14 further comprising a channel mark defined in the tube body outer surface.

19. The finned tube of claim 14 wherein the fin top further comprises a plurality of depressions and a plurality of peaks defined between adjacent depressions.

20. The finned tube of claim 19 further comprising a plurality of platforms extending from the fin top at the depressions.

21. The finned tube of claim 14 wherein the tube body includes an inner surface, the finned tube further comprising a ridge defined on the tube body inner surface.

22. The finned tube of claim 14 where the connection between the shelf wall and the wing side surface forms a sharp point.

23. The finned tube of claim 22 where the connection between the shelf wall and the fin side wall forms a sharp point.

* * * * *